US010267496B2

(12) United States Patent
Kwong

(10) Patent No.: US 10,267,496 B2
(45) Date of Patent: Apr. 23, 2019

(54) LED COVERS AND LED LIGHT BULBS INCORPORATING THE SAME

(71) Applicant: NOBLE CORPORATION, Zhong Shan, Guangdong Province (CN)

(72) Inventor: Hing Chuen Allan Kwong, Zhong Shan (CN)

(73) Assignee: Gardenia Industrial Limited, Road Town, Tortola (VG)

( * ) Notice: Subject to any disclaimer, the term of this patent is extended or adjusted under 35 U.S.C. 154(b) by 88 days.

(21) Appl. No.: 14/997,175

(22) Filed: Jan. 15, 2016

(65) Prior Publication Data

US 2016/0377239 A1 Dec. 29, 2016

(30) Foreign Application Priority Data

Jun. 26, 2015 (CN) ..... 2015 2 0455890 U

(51) Int. Cl.

| | |
|---|---|
| ***F21V 17/16*** | (2006.01) |
| ***F21V 5/00*** | (2018.01) |
| ***F21V 29/74*** | (2015.01) |
| ***F21V 3/06*** | (2018.01) |
| ***F21V 3/02*** | (2006.01) |
| ***F21V 3/04*** | (2018.01) |
| ***F21K 9/20*** | (2016.01) |
| *F21V 19/00* | (2006.01) |
| *F21Y 115/10* | (2016.01) |

(52) U.S. Cl.

CPC ..... *F21V 17/164* (2013.01); *F21K 9/20* (2016.08); *F21V 3/02* (2013.01); *F21V 3/049* (2013.01); *F21V 3/062* (2018.02); *F21V 5/002* (2013.01); *F21V 5/005* (2013.01); *F21V 29/74* (2015.01); *F21V 19/003* (2013.01); *F21Y 2115/10* (2016.08)

(58) Field of Classification Search

CPC ..... F21Y 2115/10; F21K 9/232; F21K 9/66; F21K 9/20; F21V 3/00; F21V 3/02; F21V 5/04; F21V 5/00; F21V 5/002; F21V 29/70; F21V 19/003; F21V 17/164; F21V 29/74; F21V 3/062; F21V 3/049; F21V 5/005

USPC ..... 362/294

See application file for complete search history.

(56) References Cited

U.S. PATENT DOCUMENTS

2004/0026683 A1* 2/2004 Yamada ..... H01L 25/0753 257/10
2013/0285531 A1* 10/2013 Yuan ..... F21V 5/048 313/110
2013/0286664 A1* 10/2013 Wang ..... F21V 3/0436 362/341
2014/0071678 A1* 3/2014 Chen ..... F21V 21/00 362/249.02

(Continued)

*Primary Examiner* — Anh T Mai
*Assistant Examiner* — Meghan K Ulanday
(74) *Attorney, Agent, or Firm* — Lewis Roca Rothgerber Christie LLP

(57) ABSTRACT

A translucent cover for an LED light bulb is disclosed. The translucent cover includes a cover body made from a light-transmissive material, light-scattering particles in the light-transmissive material, and a series of micro-structure features on and inner surface of the cover body. The micro-structure features are configured to refract and reflect light emitted from the LED light bulb to increase the emission angle of the light emitted from the cover.

10 Claims, 6 Drawing Sheets

(56) References Cited

U.S. PATENT DOCUMENTS

| | | | | |
|---|---|---|---|---|
| 2014/0152177 | A1* | 6/2014 | Matsuda | F21K 9/90<br>315/32 |
| 2014/0204589 | A1* | 7/2014 | Moon | F21V 7/10<br>362/310 |
| 2014/0312762 | A1* | 10/2014 | Tsai | F21K 9/50<br>313/111 |

* cited by examiner

LED COVERS AND LED LIGHT BULBS INCORPORATING THE SAME

CROSS-REFERENCE TO RELATED APPLICATION

The present application claims priority to and the benefit of Chinese Application No. 201520455890.5, filed Jun. 26, 2015, the entire contents of which are incorporated herein by reference.

FIELD

The present disclosure relates generally to light emitting diode light bulbs and covers for light emitting diode light bulbs.

BACKGROUND

Related art light emitting diode (LED) light bulbs, such as the LED bulb shown in FIG. 1, typically include a translucent cover 101, a heat sink casing 102, an LED light board (not shown) having at least one LED housed in the heat sink casing 102, a power driver module (not shown in FIG. 1) coupled to the LED light board, and a cap 103 having external threads configured to facilitate coupling the LED light bulb to a socket. With related art LED bulbs, light emitted from the one or more LEDs and passing through the translucent cover 101 has a limited light emission angle, such as approximately 120°. Additionally, related art LED bulbs often produce uneven illumination (e.g., dark spots) and other undesirable lighting effects, which render related art LED light bulbs unsuitable for many applications, such as decorative lighting applications.

SUMMARY

The present disclosure is directed to various embodiments of a translucent cover for a light emitting diode (LED) light bulb. In one embodiment, the translucent cover includes a cover body including a light-transmissive material, a series of light-scattering particles in the light-transmissive material, and a series of micro-structure features on an inner surface of the cover body configured to refract and reflect light emitted from an LED light bulb. The micro-structure features may include a series of projections, depressions, or combinations thereof. The projections and/or depressions may have any suitable shape, such as spherical, prismatic (e.g., square pyramidal), conical, cylindrical, or portions thereof. The light-scattering particles may be scattered throughout the cover body. The light-transmissive material may be any suitable material, such as polycarbonate (PC), poly(methyl methacrylate) (PMMA), polystyrene (PS), acrylonitrile butadiene styrene (ABS), polyvinyl chloride (PVC), or combinations thereof. The inner surface of the cover body may be spherical or aspheric. The translucent cover may include a series of hooks extending from the cover body. The hooks are configured to couple the translucent cover to one or more components of an LED light bulb. Each hook may include a resilient arm extending downward from a lower edge of the cover body and an elastic arm extending inward from a free end of the resilient arm. The light-scattering particles may include an organic agent, an inorganic agent, or combinations thereof.

The present disclosure is also directed to various embodiments of an LED light bulb. In one embodiment, the LED light bulb includes a heat sink, an LED board including a substrate and a series of LED lights on the substrate, a pressure ring surrounding the LED board and coupling the LED board to a mounting surface of the heat sink, and a translucent cover coupled to the pressure ring. The translucent cover includes a cover body including a light-transmissive material, a series of light-scattering particles in the light-transmissive material, and a series of micro-structure features on an inner surface of the cover body configured to refract and reflect light emitted from the LED lights. The translucent cover may include a series of hooks extending from the cover body. Each hook may include a resilient arm extending downward from a lower edge of the cover body and an elastic arm extending inward from a free end of the resilient arm. The hooks engage the pressure ring to couple the translucent cover to the pressure ring.

This summary is provided to introduce a number of concepts that are further described below in the detailed description. This summary is not intended to identify key or essential features of the claimed subject matter, nor is it intended to be used in limiting the scope of the claimed subject matter.

BRIEF DESCRIPTION OF THE DRAWINGS

These and other features and advantages of embodiments of the present disclosure will become more apparent by reference to the following detailed description when considered in conjunction with the following drawings. In the drawings, like reference numerals are used throughout the figures to reference like features and components. The figures are not necessarily drawn to scale.

DETAILED DESCRIPTION

The present disclosure is directed to various embodiments of light emitting diode (LED) light bulbs and various embodiments of translucent LED covers for LED light bulbs. The LED covers LED light bulbs incorporating the LED covers of the present disclosure are configured to refract and/or reflect light transmitted through the cover such that the emitted light has a greater light emission angle than related art LED light bulbs having related art LED covers. Additionally, the LED covers and LED light bulbs of the present disclosure are configured to generate uniform or substantially uniform light (e.g., even illumination without or substantially without the presence of dark spots). The LED covers and LED light bulbs of the present disclosure may also be configured to eliminate or at least reduce the presence of other undesirable lighting effects. For instance, the LED covers and LED light bulbs of the present disclosure may be configured to emit softer light with less glare than convention LED light bulbs using related art LED covers.

With reference now to FIGS. 2-6, a translucent LED cover according to one embodiment of the present disclosure includes a translucent body 1 having a series of light-scattering or light-diffusing particles 2 (see FIGS. 5-6) in the translucent material. In the illustrated embodiment the translucent body 1 is hemispherical, although in one or more alternate embodiments the translucent body 1 may have any other suitable shape. For instance, in one or more embodiments, the translucent body 1 may be aspherical. Additionally, in the illustrated embodiment, the translucent body 1 of the LED cover includes an inner surface 11 and an outer surface 12. When the LED cover is incorporated into an LED light bulb (see FIGS. 7A-8, for example), light emitted from one or more LEDs in the LED light bulb is first incident on the inner surface 11 of the LED cover. In the illustrated embodiment, the outer surface 12 of the translucent body 1 is smooth or substantially smooth. The light-diffusing or light-scattering particles 2 may be any suitable material, such as, for instance, an inorganic light diffusing agent (e.g., nano barium sulfate, calcium carbonate, silica, or combinations thereof), organic light diffusing agent (e.g., acrylic, styrene, acrylic resin, or combinations thereof), or combinations thereof.

Figure 1:
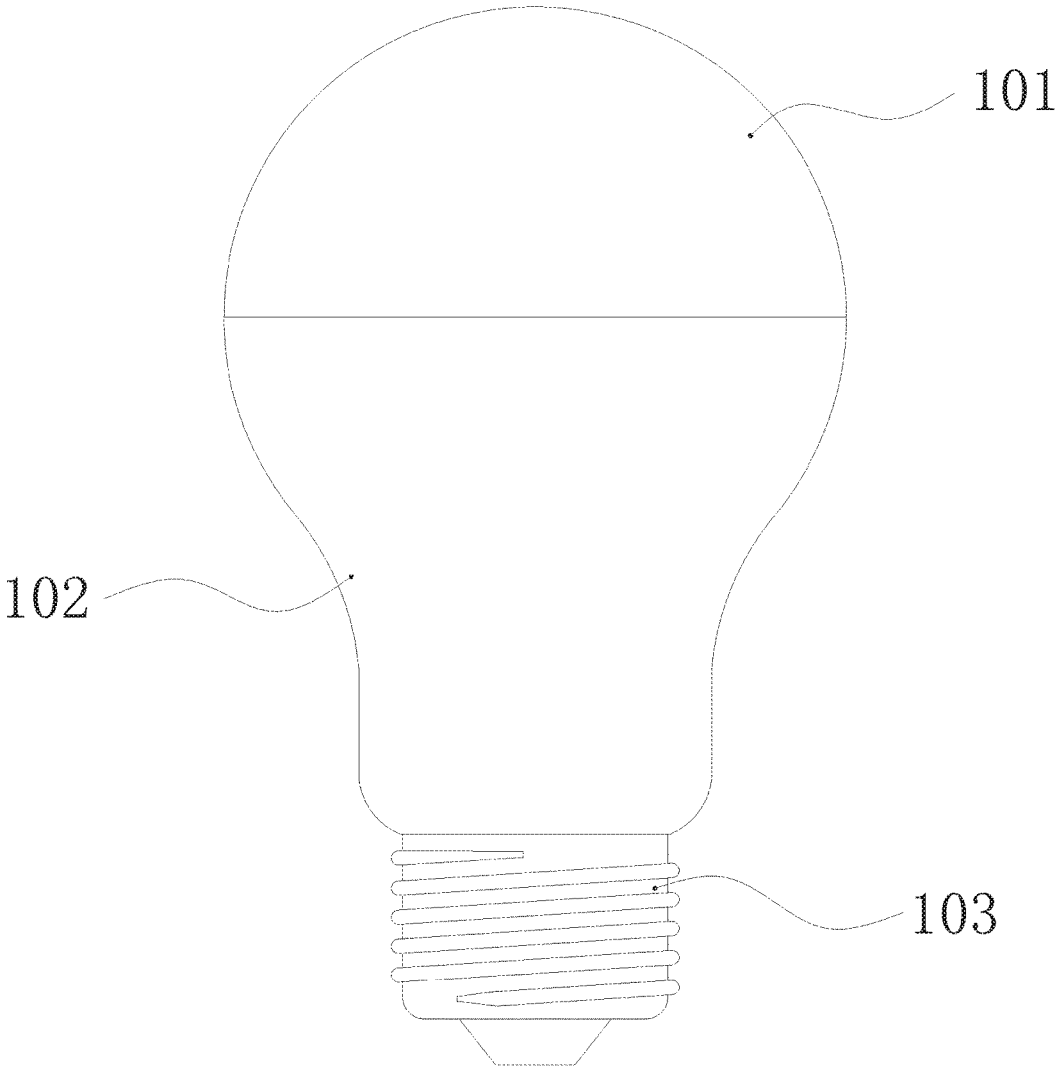
FIG. 1 Related Art
FIG. 1 is a schematic view of a related art LED bulb.
Figure 2:
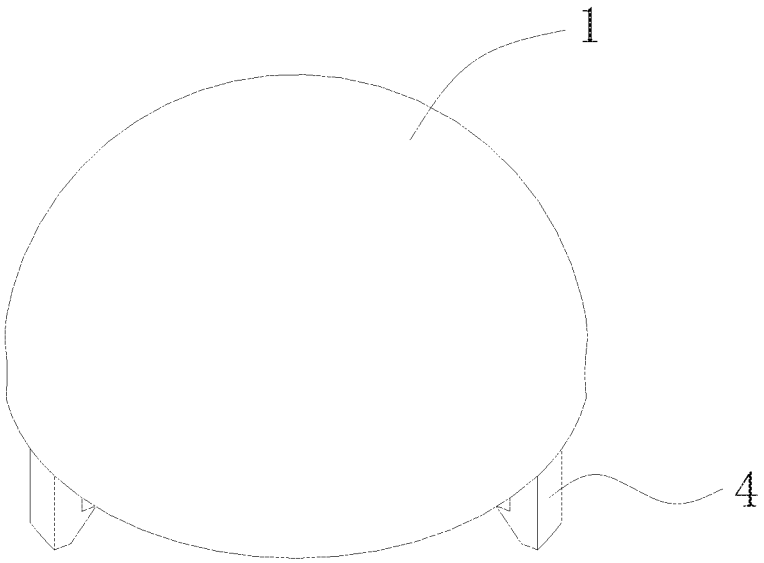
FIGS. 2-3 are upper and lower perspective views, respectively, of an LED cover according to one embodiment of the present disclosure.
Figure 3:
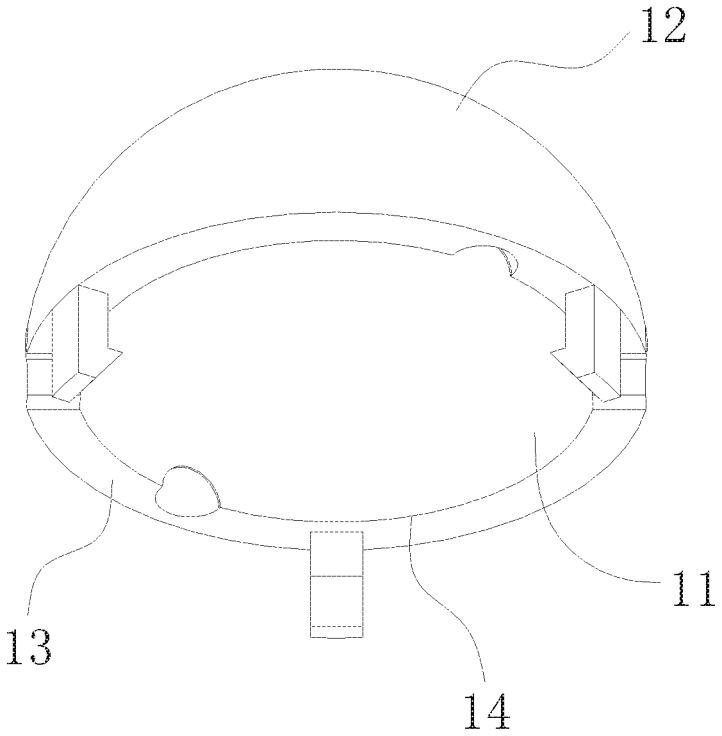
Figure 4:
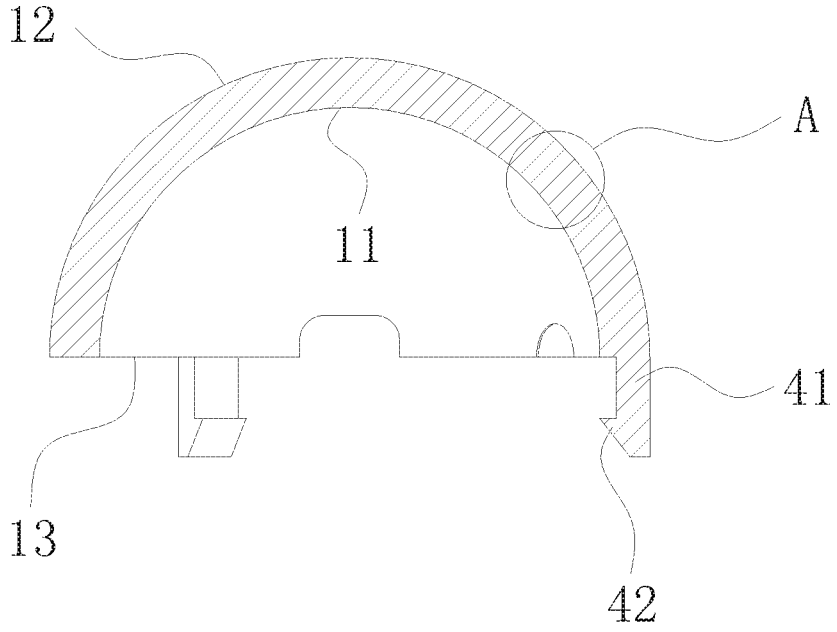
FIG. 4 is a cross-sectional view of the embodiment of the LED cover illustrated in FIGS. 2-3.
Figure 5:
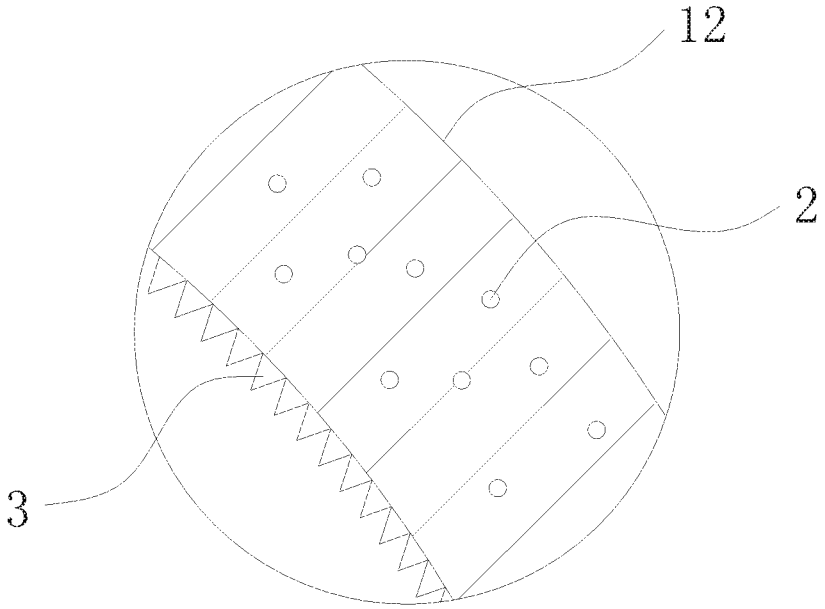
FIG. 5 is an enlarged view of portion A of the embodiment of the LED cover illustrated in FIG. 4.
Figure 6:
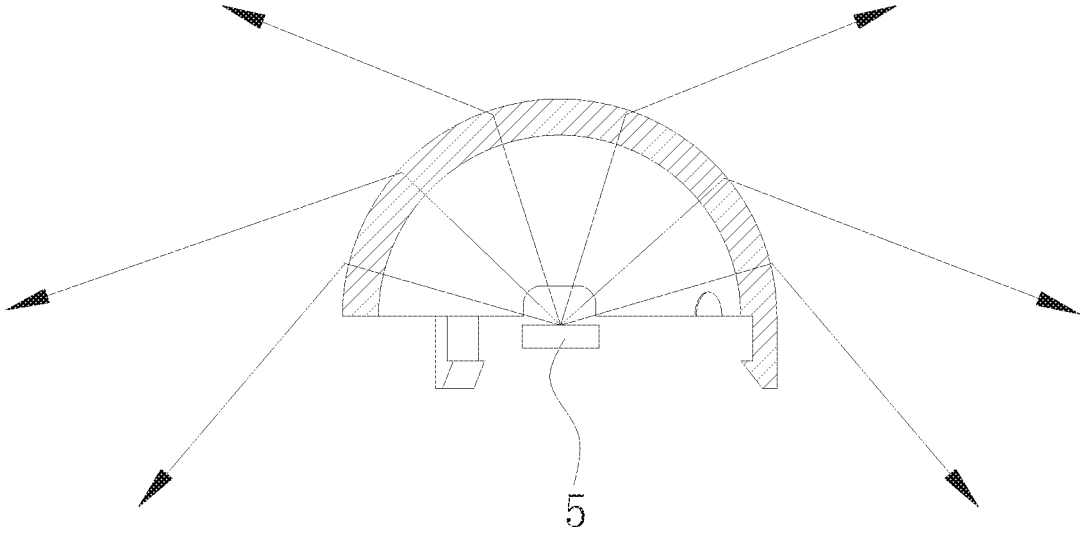
FIG. 6 is a schematic representation of light scattering through the embodiment of the LED cover depicted in FIGS. 2-5.

Additionally, in the illustrated embodiment, the inner surface 11 of the translucent body 1 includes micro-structure features 3 (see FIG. 5) that are configured to reflect and/or refract the light emitted from the one or more LEDs in the LED light bulb. In one or more embodiments, the micro-structure features 3 may include a series of projections and/or a series of depressions. The projections and/or depressions may have any suitable shape, such as, for instance, spherical, prismatic (e.g., square pyramidal), conical, cylindrical, or portions and/or combinations thereof. As illustrated in FIG. 6, the micro-structure features 3 on the inner surface 11 of the LED cover and the light-diffusing particles 2 are configured to refract and reflect light emitted from one or more LED lights in an LED light bulb to increase the emission angle of the light emitted from the LED cover compared to related art LED light bulbs having related art LED covers (e.g., the related art LED light bulb illustrated in FIG. 1). As illustrated in FIG. 6, the light beams are reflected and/or refracted off of the micro-structure features 3 (e.g., the depressions and/or protrusions) on the inner surface 11 and the light-scattering particles 2 such that the light beams emerging from the outer surface 12 LED cover are deflected downward and expand relative to the light beams emitted from the LED lights. The downward deflection of the light beams increases the emission angle of the light beams and may reduce the presence of uneven illumination (e.g., dark spots) compared to related art LED light bulbs. The body 1 of the LED may be made out of any suitable light transmissive material, such as, for instance, polycarbonate (PC), poly(methyl methacrylate) (PMMA), polystyrene (PS), acrylonitrile butadiene styrene (ABS), polyvinyl chloride (PVC), or combinations thereof.

Although in the illustrated embodiment the LED cover includes both light-scattering particles 2 and micro-structure features 3, in one or more alternate embodiments, the LED cover may include only light-scattering particles 2 or only the micro-structure features 3.

With continued reference to the embodiment illustrated in FIGS. 2-6, the LED cover includes a series of hooks 4 arranged circumferentially around a lower edge 13 of the LED cover. The hooks 4 are configured to facilitate coupling the LED cover to an LED light bulb. In the illustrated embodiment, each of the hooks 4 includes a resilient arm 41 extending down from the lower edge 13 of the LED cover. The resilient arms 41 each include a proximal end at the lower edge 13 of the LED cover and a free distal edge opposite the proximal end. In the illustrated embodiment, each of the hooks 4 also includes an elastic arm 42 extending inward from the free distal ends of the resilient arms 41 towards a center of the LED cover. Although in the illustrated embodiment the LED cover includes three hooks 4 equidistantly arranged around the lower edge 13 of the LED cover, in one or more alternate embodiments, the LED cover may include any other suitable number of hooks 4 and the hooks 4 may have any other suitable arrangement.

Figures 7A, 7B:
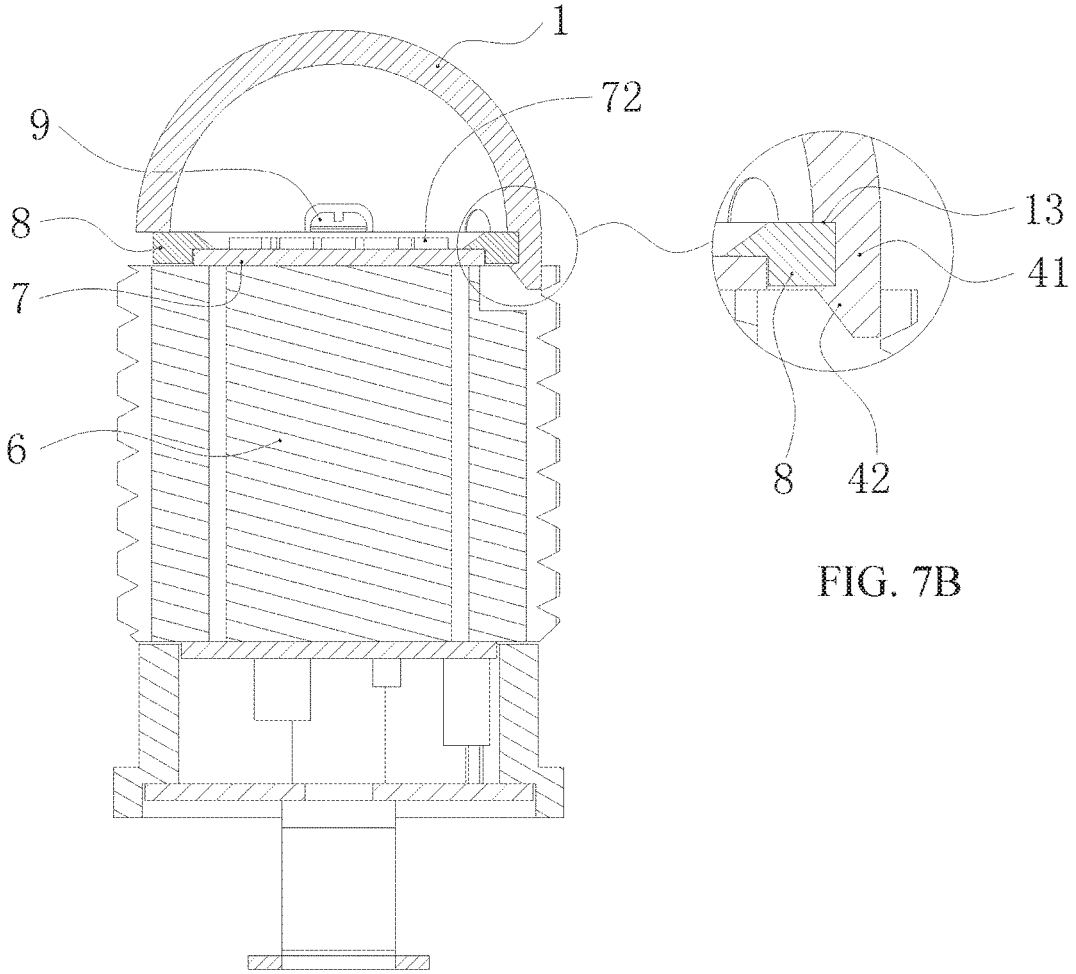
FIGS. 7A-7B are a cross-sectional view and an enlarged portion view, respectively, of an LED light bulb according to one embodiment of the present disclosure incorporating the embodiment of the LED cover depicted in FIGS. 2-5.
Figure 8:
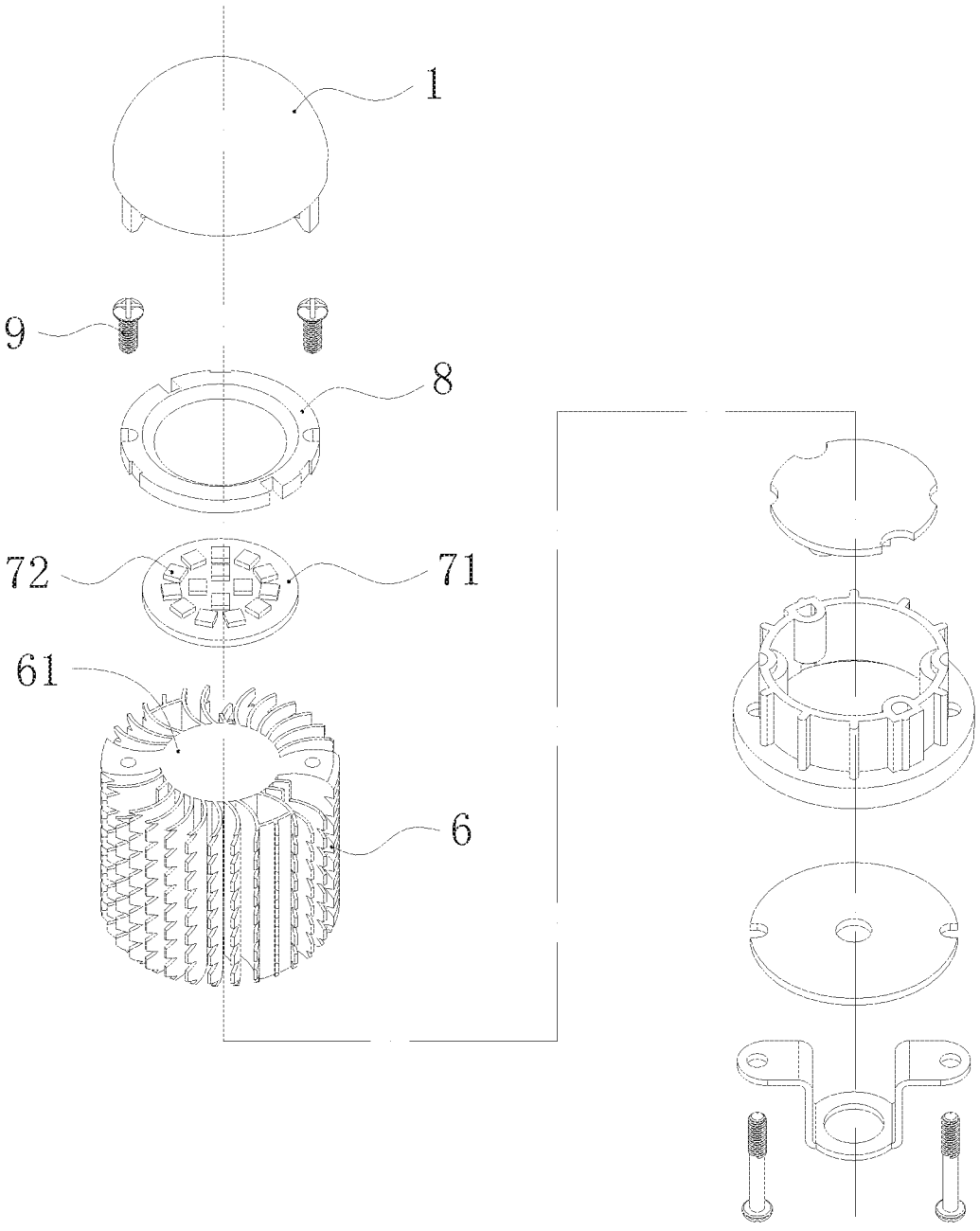
FIG. 8 is an exploded perspective view of the embodiment of the LED light bulb depicted in FIG. 7A.

FIGS. 7A-8 depict the embodiment of the LED cover illustrated in FIGS. 2-6 incorporated into an LED light bulb according to one embodiment of the present disclosure. In the embodiment illustrated in FIGS. 7A-8, the LED light bulb includes a radiator 6 (e.g., a heat sink), an LED board 7 having a substrate 71 and a series of LED lights 72 on the substrate 71, a pressure ring 8, and at least one fastener 9 (e.g., a screw) coupling the pressure ring 8 to the radiator 6. When the pressure ring 8 is coupled to the radiator 61 with the one or more fasteners 9, the substrate 71 of the LED board 7 and the pressure ring 8 are pressed against a mounting surface 61 of the radiator 61. Additionally, in the illustrated embodiment, the lower edge 13 of the LED cover is on an upper surface of the pressure ring 8 and the elastic arms 42 of the hooks 4 engage a lower surface of the pressure ring 8 to couple the LED cover to the pressure ring 8 (e.g., the hooks 4 extend under the pressure ring 8 to couple the LED cover to the pressure ring 8). In one or more embodiments, the embodiment of the LED cover illustrated in FIGS. 7A-8 may be incorporated into any other suitable LED light bulb.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," and similar terms have been used herein to describe a spatial relationship of one element to another, it is understood that these terms are intended to encompass different orientations of the various elements and components of the invention in addition to the orientation depicted in the figures. Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is referred to as being "coupled" to another component, it can be directly attached to the other component or intervening components may be present therebetween.

What is claimed is:

1. A translucent cover for an LED light bulb, the translucent cover comprising:

a cover body comprising a light-transmissive material, the cover body comprising an inner surface and an outer surface;

a plurality of hooks extending from the cover body, each hook of the plurality of hooks comprising a resilient arm extending downward from a lower edge of the cover body and an elastic arm extending inward from a free end of the resilient arm;

a plurality of solid light-scattering particles in the light-transmissive material; and a plurality of micro-structure features on the inner surface of the cover body configured to refract and reflect light emitted from the LED light bulb, wherein the plurality of micro-structure features comprise at least one of a plurality of projections and a plurality of depressions, and wherein the at least one of the plurality of projections and the plurality of depressions have a shape selected from the group of shapes consisting of prismatic, conical, cylindrical, and portions thereof.

2. The translucent cover of claim 1, wherein the plurality of solid light-scattering particles are scattered throughout the cover body.

3. The translucent cover of claim 1, wherein the light-transmissive material is selected from the group of materials consisting of PC, PMMA, PS, ABS, and PVC.

4. The translucent cover of claim 1, wherein the inner surface of the cover body is spherical or aspheric.

5. The translucent cover of claim 1, wherein the plurality of solid light-scattering particles comprises an organic agent or an inorganic agent.

6. The translucent cover of claim 1, wherein a material of the plurality of solid light-scattering particles is selected from the group of materials consisting of nano barium sulfate, calcium carbonate, silica, acrylic, styrene, acrylic resin, and combinations thereof.

7. The translucent cover of claim 1, wherein the plurality of solid light-scattering particles have a substantially uniform size and shape.

8. The translucent cover of claim 1, wherein the solid light-scattering particles are located throughout an entirety of the translucent cover.

9. The translucent cover of claim 1, wherein the shape is a triangular cross-sectional shape.

10. An LED light bulb, comprising:

a heat sink;

an LED board comprising a substrate and a plurality of LED lights on the substrate;

a pressure ring surrounding the LED board and coupling the LED board to a mounting surface of the heat sink; and a translucent cover coupled to the pressure ring, the translucent cover comprising:

a cover body comprising a light-transmissive material, the cover body comprising an inner surface and an outer surface;

a plurality of hooks extending from the cover body, each hook of the plurality of hooks comprising a resilient arm extending downward from a lower edge of the cover body and an elastic arm extending inward from a free end of the resilient arm, the elastic arm of each of the plurality of hooks engaging a lower surface of the pressure ring to couple the translucent cover to the pressure ring;

a plurality of solid light-scattering particles in the light-transmissive material, wherein a material of the plurality of solid light-scattering particles is selected from the group of materials consisting of nano barium sulfate, calcium carbonate, styrene, and combinations thereof; and a plurality of micro-structure features on the inner surface of the cover body configured to refract and reflect light emitted from the plurality of LED lights.

* * * * *